United States Patent [19]

Moraw et al.

[11] 4,380,388

[45] Apr. 19, 1983

[54] CYCLIC ELECTROPHOTOGRAPHIC COPYING PROCESS

[75] Inventors: Roland Moraw; Günther Schädlich, both of Wiesbaden, Fed. Rep. of Germany

[73] Assignee: Kalle, Niederlassung der Hoechst AG, Wiesbaden, Fed. Rep. of Germany

[21] Appl. No.: 217,423

[22] Filed: Dec. 17, 1980

[30] Foreign Application Priority Data

Dec. 17, 1979 [DE] Fed. Rep. of Germany ..... 2950769

[51] Int. Cl.[3] ..... G03G 21/00

[52] U.S. Cl. ..... 355/15; 118/652; 134/42; 355/77; 430/125

[58] Field of Search ..... 355/15, 10, 77; 430/125; 118/652; 134/1, 42, 9

[56] References Cited

U.S. PATENT DOCUMENTS

RE. 28,586 10/1975 Saito et al. ..... 355/15

4,080,059 3/1978 Tani et al. ..... 355/15

4,165,172 8/1979 Okamoto et al. ..... 355/15

OTHER PUBLICATIONS

Riyouji Katou, Cleaning Device for Zerography, Abstract of published Japanese Application No. 54-116928, Mar. 2, 1978.

*Primary Examiner*—R. L. Moses

*Attorney, Agent, or Firm*—Schwartz, Jeffery, Schwaab, Mack, Blumenthal & Koch

[57] ABSTRACT

An electrophotographic copying process is disclosed comprising the steps of performing a cleaning operation on a recording element by carrying out at least one rinsing operation of the element utilizing a first quantity of a developer liquid; performing a series of copying cycles comprising charging, exposing, developing with a liquid developer, transferring and fixing; and intermittently performing additional cleaning operations independently of each cycle of the series of copying cycles using a quantity of developer liquid which is at most as great as the first quantity.

16 Claims, 1 Drawing Figure

CYCLIC ELECTROPHOTOGRAPHIC COPYING PROCESS

BACKGROUND OF THE INVENTION

The present invention relates generally to a cyclic electrophotographic copying process comprising the steps of producing a charge pattern by electrostatically charging and exposing a recording element, rendering a toner image visible with a pigmented developer liquid, and transmitting the image to an image-receiving material. More particularly, the invention relates to a copying proces wherein the surface of the recording element is cleaned with developer liquid before submission to a new copying cycle.

DE-AS No. 21 36 998, herein incorporated by reference, discloses an arrangement for producing electrophotographic copies by electrostatically charging the photoconductive layer of a recording element at each copying cycle, exposing the recording element to produce a latent charge image, and developing the latent charge image by applying oppositely charged pigmented particles. The toner image is then transmitted to an image-receiving material, such as paper, where it is fixed. Thereafter, the recording element is cleaned by rinsing with a constant amount of developer and freed of the toner and residual charge. If pigmented developer liquids are used, the cleaning operation includes rinsing the recording element with developer liquid using a cleaning device, such as a cleaning blade of an elastic material or a rotating brush (see French Pat. No. 2,000,397), or alternatively by leading the recording element through a cleaning chamber (see DE-AS No. 12 37 901).

As indicated above, the central component of a cyclically operating electrophotographic copier is the recording element comprising a photoconductor drum or a photoconductor element having a photoconductive layer including an organic photoconductor, such as, poly-N-vinylcarbazole and trinitrofluorenone, which is applied to a flexible support comprising a polyester film on an aluminum layer. Additionally, photoconductive layers of inorganic materials, such as selenium, can be doped, and applied to a metal drum.

Typically, the individual process stations are arranged around the recording element. During the cleaning operation of the photoconductive layer, developer liquid from a supply container is pumped onto the surface of the photoconductive layer, distributed by means of a foam-coated roller, and then wiped off with the aid of an resilient cleaning blade adjacent to the photoconductive layer. If possible, the photoconductive layer should be wiped dry. The cleaning station is preferably installed at an elevated spot on the photoconductor path, so that the developer liquid flows back into the supply container situated beneath the recording element. (See, e.g., DE-AS No. 21 54 892, herein incorporated by reference).

In FIG. 1 of the attached drawings an arrangement of the process stations is illustrated in a schematic and simplified manner. Situated around a recording element 1, illustrated as a photoconductor drum, are a charging station 2, an image-wise exposure station 3 and a developing station comprising a developing electrode 6 and a developer liquid 4 in a developer container 5. After the transfer of the toner image to the image-receiving material 7, cleaning is effected at the cleaning station which can include a foam roller 8 and a cleaning blade 9 of solvent-resistant rubber. Using a pump 10, developer liquid is transported into the cleaning station and then flows downwardly along the end surfaces of the recording element and back into the developer container 5.

One disadvantage of the prior art cleaning performance is the loss by evaporation of some of the dispersing liquid due to the free fall of large quantities of developer liquid. These losses may be greater than the losses occurring via the image-receiving materials, especially at increased surrounding or instrument temperature when using aliphatic hydrocarbons as dispersing agents, which is the common practice. Furthermore, deleterious changes in the developer liquid are observed due to the cyclic cleaning and subsequent return flow in a free fall, resulting in a considerable reduction of the copy quality, caused by the loss of dispersing agent which disturbs the sensitive system of charged pigmented particles and additives.

SUMMARY OF THE INVENTION

Accordingly, it is an object of the present invention to provide an improved cleaning method for treating the recording element used in cyclically operating electrophotographic copying processes which avoids the disadvantages described above.

Another object of the present invention is to provide a cleaning method which tends to prolong the operating life of the developer liquid as well as reduce environmental problems.

In accomplishing the foregoing objects, there has been provided according to the present invention an electrophotographic copying process comprising the steps of performing a preliminary cleaning operation on a recording element by carrying out at least one rinsing operation of the element utilizing a first quantity of a developer liquid; performing a series of copying cycles comprising charging, exposing, developing with a liquid developer, transferring and fixing; and intermittently performing additional cleaning operations independently from each copying cycle of the series of copying cycles using a second quantity of developer liquid which is at most as great as the first quantity. Under certain conditions, the cleaning operation can be omitted completely during the copying cycles so long as cleaning operations are performed before and after each series of copies. Additionally, a preferred embodiment of the process utilizes a developer liquid having a dispersing agent with a relatively high evaporation number, e.g., preferably above about 70.

BRIEF DESCRIPTION OF THE DRAWING

The foregoing and other objects, features and advantages of the invention will become apparent from the following more particular description of the preferred embodiments of the invention, as illustrated in the accompanying drawing together with Table I. The drawing is not necessarily to scale, emphasis instead being placed in illustrating the principles of the invention.

The single FIGURE illustrates a cyclic electrophotographic copier for carrying out the process according to the present invention.

DETAILED DESCRIPTION OF PREFERRED EMBODIMENTS

Figure 1:
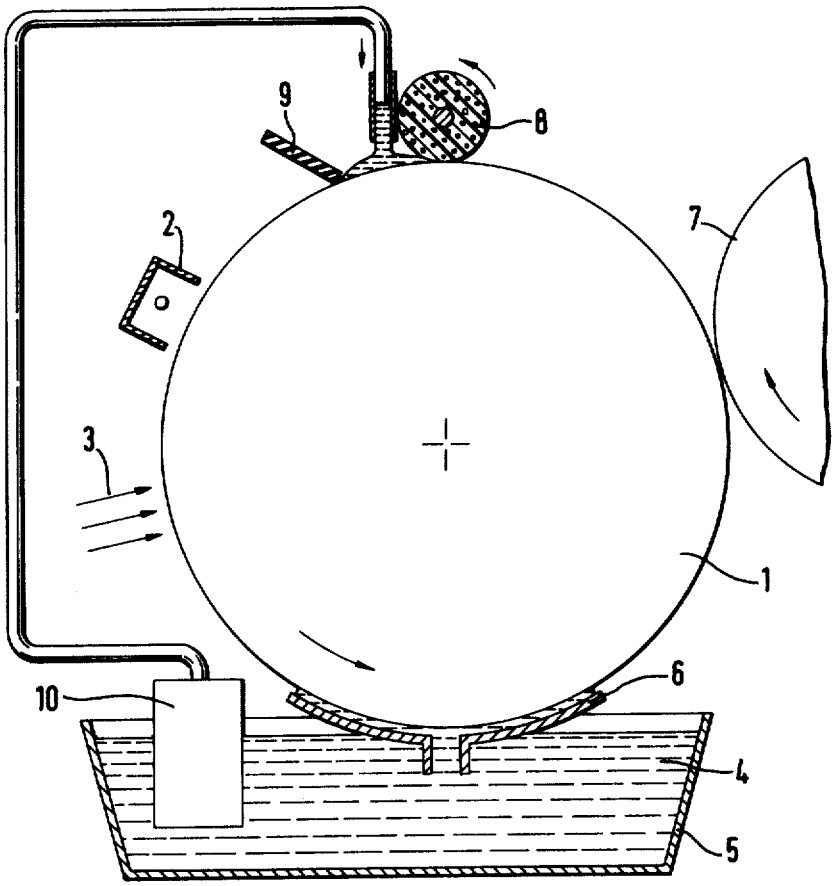

Contrary to the prevailing opinion and common practice it has been found unnecessary to thoroughly rinse the recording element of an electrophotographic copier with developer liquid after each copying cycle, especially if several copies are made from one original or when successive copies of different originals are made, e.g., with the aid of an original feeder. Accordingly, it has been found that after the first or the first few copies, rinsing with developer liquid can be reduced or completely omitted during the further copying cycles for a predetermined number of copies. It is advisable, though not absolutely necessary, to rinse thoroughly after the last copy.

Preferably, cleaning is carried out before and after a series of copies.

By doing so, the result is achieved that less developer liquid evaporates and that changes in the developer occur more slowly compared with traditional process methods.

The process sequence according to the present invention is set forth in Table I which indicates whether rinsing is carried out with the conventional full quantity A of developer liquid for each copying cycle 1 through Z, a less than full quantity "a" or no rinsing as indicated by the quantity zero (0). For each process specified in Table I, the rinsing operation indicated is continued after each copying cycle unless a different rinsing operation is noted. For example, in process III, "0A0" indicates a copying cycle without a rinsing operation, followed by a copying cycle with a rinsing operation, using a conventional quantity of developer toner, followed by a copying cycle without a rinsing operation. Further, the use of ". . ." designates a repetition of the particular rinsing operation indicated. For example, in process VI, "a . . ." designates the rinsing of the recording element with a reduced amount of developer liquid after each copying cycle of the series of copying cycles 1 through Z.

According to the present invention, each process includes a pre-run phase (V) wherein one or several rinsing operations A . . . are performed before copying begins. During this phase, the recording element is cleaned by thoroughly rinsing. Process I indicates a method of operation for copying after a long period of non-use, such as overnight, wherein a full quantity A is used to rinse the recording element after each of the first few copying cycles, to make sure that the foam roller 8 is thoroughly wetted. The further control of the rinsing intervals then depends on the respective copying conditions. In most cases no rinsing is needed during continuous copying, as indicated by process II. For processes III–IV, it is necessary to operate the rinsing mechanism only after a predetermined number of copies, such as in process III, wherein rinsing can be carried out once, or several times as contemplated by process IV.

During the post-run phase N, as the copying operation is finished, thorough cleaning is preferably carried out utilizing a single or several rinsing operations A . . . as indicated by processes I through IV.

Under favorable conditions, such as good redispersibility of deposited pigments, one rinsing operation A after finishing the last copy Z will suffice as contemplated by process V. In more complicated cases, where, e.g., the dispersed pigments tend to deposit, rinsing is carried out after the last or the last few copies Z and in the post-run phase N, e.g., as proposed by process I.

It has been found that one factor which affects the efficiency of the rinsing operation is the quality of the developer liquid used. Those developer liquids wherein separated pigment particles can be redispersed relatively easily do not need any or need very few intermediate rinsing operations. Conversely, those developer liquids wherein deposited pigment particles are not readily redispersed require additional intermediate rinsing operations.

It is also advantageous to rinse with reduced quantities of developer liquid, such as, with about half the normal quantity. Depending on the individual requirements, it will be useful to rinse with a reduced quantity "a" (process VI) or to combine the full rinsing quantity A and the reduced quantity "a" in an appropriate way, so that the number of full-quantity rinsing operations is reduced to a minimum (process VII), whereby care has to be taken that no background or ghosting appears. In many cases, intermediate rinsing with the reduced quantity "a" will be sufficient (process VIII). Even finer variations of the rinsing quantities are contemplated by the present invention, wherein the cleaning operation is effected by combining the different processes, so that rinsing is performed at certain intervals with varying quantities of developer liquid.

As illustrated in the FIGURE, control of the quantity of developer liquid used for cleaning or rinsing, is effected by switching a pump motor 10 on or off or by opening and closing a valve, advantageously a three-way valve using a control unit such as a microprocessor which occupies very little space. By using a microprocessor it is possible to design a switching mechanism for the control unit which is actuated via a copy counter, not shown in the drawing.

Besides the redispersibility of the pigments contained in the developer liquids, the evaporation speed of the dispersing agent is a further criterion for the choice of the respective rinsing or cleaning process. When using fast-evaporating dispersing agents, the number of intermittent rinsing operations may have to be increased to prevent the liquid film remaining on the photoconductive layer after the transfer to the image-receiving material 7 from becoming noticeably dry before cleaning. This will occur especially when the customary, aliphatic hydrocarbons are used as dispersing agents which have evaporation numbers of up to about 50 (the evaporation number of ether is 1). For this reason, dispersing liquids which evaporate to a smaller degree during the copying process are preferred for this invention. Such dispersing liquids have evaporation numbers of more than about 70, preferably of more than about 120. Thus, it is possible to reduce the evaporation of the developer liquid effectively, and at the same time to diminish the quality-reducing changes in the developer liquid. Under favorable conditions, i.e., if the pigments are easily redispersible and if the developer liquid has a high evaporation number, more than 200 copies can be produced without cleaning, before the quality of the copies is reduced to an unacceptable level.

Although the process is described with reference to a photoconductor drum, it may also be practiced with a photoconductor tape- or band- arrangement. In this case, the developer liquid must be prevented from flowing to the backside of the tape or band in noticeable quantities. By reducing rinsing, this danger is decreased, so that the process according to the present invention favors the use of photoconductor tapes or bands in the case of liquid developing.

A quantitative description of one embodiment of the process according to this invention is given by the following Example.

In a commercial copying apparatus, copies were made with a developer liquid containing as its dispersing agent an aliphatic hydrocarbon having a boiling range of 160° C.-180° C. and an evaporation number of about 40.

During continuous copying, cleaning was omitted, as described by process I, whereby the total consumption of dispersing liquid could be reduced by up to 30–40%, i.e., for the production of 100 copies it decreased from 0.35 g/DIN A 4 copy to 0.22 g/DIN A 4 copy, at an ambient temperature of 27° C.

With the developer liquid employed, 23,000 copies would be produced, instead of 17,000 copies previously obtained with the cleaning mechanism switched on for each copy cycle. The liquid film left on the recording element in the cleaning station is very thin when using this dispersing liquid.

With a developer liquid having as its dispersing agent an aliphatic hydrocarbon with a boiling range of about 210° C.-260° C. and an evaporation number of 680, copying according to process I could be safely practiced, without the risk of running dry.

For these tests, the pump 10 for transporting the developer liquid to the cleaning station was switched on and off.

Although this description refers to electrophotographic copying techniques, the present invention is, without any restrictions, suitable for cleaning recording elements which are cyclically used and upon which charge images are developed with developer liquids, and wherein after the transfer, the recording elements are cleaned.

TABLE I

| PROCESS | PRE-RUN PHASE V | COPYING CYCLES 1 | | | | Z | POST-RUN PHASE N |
|---|---|---|---|---|---|---|---|
| I | A . . . | A . . . | O | | . . . O | A | A . . . |
| II | A . . . | O | | | . . . | O | A . . . |
| III | A . . . | O . . . | OAO | | . . . | O | A . . . |
| IV | A . . . | O OA | . . . | | A | O | A . . . |
| V | A . . . | O | . . . | | | OA | O |
| VI | A . . . | a | . . . | | | a | A . . . |
| VII | A . . . | a . . . | aA . . . | Aa . . . | | a | A . . . |
| VIII | A . . . | O . . . | Oa . . . | aO . . . | | a | A . . . |

What is claimed is:

1. An electrophotographic copying process comprising the steps of:

performing a cleaning operation on a recording element by carrying out at least one rinsing operation of the element utilizing a first quantity of a developer liquid;

performing a series of copying cycles comprising charging, exposing, developing with a liquid developer, transferring and fixing; and after at least one copying cycle, performing additional cleaning operations by rinsing the element with a second quantity of developer liquid which is between "0" and "a" wherein "a" is an amount less than said first quantity and "0" means a completely omitted rinsing of developer liquid; the supply of developer liquid for rinsing said element being at least partially interrupted during said series of copying cycles.

2. A copying process as recited in claim 1, wherein said additional cleaning operations are performed after every second copying cycle at most.

3. A copying process as recited in claim 1, wherein no additional cleaning operations are performed except for a final cleaning operation carried out after each series of copying cycles.

4. A copying process as recited in claim 1, wherein a final cleaning operation is carried out after each series of copying cycles.

5. A copying process as recited in claim 1, 2, 3 or 4, wherein said developer liquid contains a dispersing agent having an evaporation number at least as high as about 70.

6. A copying process as recited in claim 5, wherein said dispersing agent has an evaporation number at least as high as about 120.

7. An electrophotographic copying process as recited in claim 1, comprising the steps of performing a cleaning operation on a recording element by carrying out at least one rinsing operation of the element utilizing said first quantity of a developer liquid; rinsing the element with said first quantity of developer liquid after each copying cycle for a predetermined number of consecutive copying cycles at the beginning of a series of copying cycles, performing a predetermined number of consecutive copying cycles of the series of copying cycles without rinsing the element; rinsing the element with said first quantity of developer liquid after each copying cycle for the remaining copying cycles of the series of copying cycles; and performing a cleaning operation on the recording element by carrying out at least one rinsing operation of the element with said first quantity of developer liquid after the finish of the series of copying cycles.

8. An electrophotographic process as recited in claim 1, comprising the steps of performing a cleaning operation on a recording element by carrying out at least one rinsing operation of the element with said first quantity of a developer liquid; performing a series of copying cycles without rinsing the element; and performing a cleaning operation on the element by carrying out at least one rinsing operation of the element with said first quantity of developer liquid after completing the series of copying cycles.

9. An electrophotographic process as recited in claim 1, comprising the steps of performing a cleaning operation on a recording element by carrying out at least one rinsing operation of the element with said first quantity of a developer liquid; performing a series of copying cycles without rinsing the element except for a single copying cycle at the middle of the series of copying cycles after which the element is rinsed with said first quantity of developer liquid; and performing a cleaning operation on the element by carrying out at least one rinsing operation of the element with said first quantity of developer liquid after completing the series of copying cycles.

10. A copying process as recited in claim 9, wherein the element is rinsed with said first quantity of developer liquid for a predetermined number of consecutive copying cycles at the middle of the series of copying cycles.

11. An electrophotographic process as recited in claim 1, comprising the steps of rinsing a recording element at least once with said first quantity of a developer liquid, performing a series of copying cycles without rinsing the element except for a single copying cycle at the end of a series of copying cycles after which the element is rinsed with said first quantity of developer liquid.

12. An electrophotographic copying process as recited in claim 1, comprising the steps of rinsing a recording element at least once with said first quantity of a developer liquid; rinsing the element with said second quantity of developer liquid "a" less than said first quantity after each copying cycle of a series of copying cycles; and rinsing the element at least once with said first quantity of developer liquid after finishing the series of copying cycles.

13. An electrophotogrphic copying process as recited in claim 1, comprising the steps of rinsing a recording element at least once with said first quantity of a developer liquid; rinsing the element with said second quantity of developer liquid "a" less than said first quantity after each copying cycle for a predetermined number of copying cycles at the beginning of a series of copying cycles; rinsing the element with said first quantity of developer liquid after each copying cycle for a predetermined number of copying cycles at the middle of the series of copying cycles; rinsing the element with said second quantity of developer liquid "a" after each copying cycle for the remaining copying cycles of the series of copying cycles; and rinsing the element at least once with said first quantity after the series of copying cycles if finished.

14. An electrophotographic copying process as recited in claim 1, comprising the steps of rinsing the recording element at least once with said first quantity of a developer liquid; performing a series of copying cycles without rinsing the element except for a predetermined number of consecutive copying cycles at the middle of the series after which the element is rinsed with said second quantity of developer liquid "a" less than the first quantity; and rinsing the element at least once with said first quantity after the series of copying cycles is finished.

15. A process as recited in claim 12, 13 or 14 wherein said second quantity of developer liquid is about half of said first quantity.

16. An electrophotographic copying apparatus comprising means for performing a cleaning operation on a recording element by carrying out at least one rinsing operation of said element utilizing a first quantity of a developer liquid; means for performing a series of copying cycles; and means for performing additional cleaning operations after at least one copying cycle by rinsing said element with a second quantity of developer liquid which is between "0" and "a", wherein "a" is an amount less than said first quantity and "0" means a completely omitted rinsing of developer liquid; said apparatus further comprising means for at least partially interrupting the supply of liquid developer for rinsing said recording element during part of said series of copying cycles.

* * * * *